US011732458B2

(12) United States Patent
Amzallag

(10) Patent No.: US 11,732,458 B2
(45) Date of Patent: Aug. 22, 2023

(54) WATER TRAP HAVING A ROTARY VALVE

(71) Applicant: Avraham Amzallag, Tel Aviv (IL)

(72) Inventor: Avraham Amzallag, Tel Aviv (IL)

( * ) Notice: Subject to any disclaimer, the term of this patent is extended or adjusted under 35 U.S.C. 154(b) by 0 days.

(21) Appl. No.: 17/567,352

(22) Filed: Jan. 3, 2022

(65) Prior Publication Data

US 2022/0120075 A1 Apr. 21, 2022

Related U.S. Application Data

(63) Continuation-in-part of application No. PCT/IL2020/050740, filed on Jul. 2, 2020.

(30) Foreign Application Priority Data

Jul. 4, 2019 (IL) ..... 267866
Oct. 27, 2019 (IL) ..... 270194

(51) Int. Cl.
*E03F 5/20* (2006.01)
*F04F 10/00* (2006.01)

(52) U.S. Cl.
CPC ..... *E03F 5/20* (2013.01); *F04F 10/00* (2013.01); *Y10T 137/86236* (2015.04)

(58) Field of Classification Search
CPC ... E03F 5/20; F04F 10/00; F04F 10/02; E03C 1/12–335; E03C 1/288; E03C 1/286; E03C 1/284; E03C 1/282; E03C 1/29; E03C 1/26; E03C 1/30; Y10T 137/86236; Y10T 137/86244; Y10T 137/8626; F16T 1/383
USPC ..... 137/216.2, 247.13, 247.35, 247.45, 137/247.39, 247.37, 577.5, 579; 4/679–694, 256.1, 301; 251/343–345, 251/340
See application file for complete search history.

(56) References Cited

U.S. PATENT DOCUMENTS

| | | | | |
|---|---|---|---|---|
| 340,202 | A * | 4/1886 | Edwards | 137/247.35 |
| 3,651,826 | A * | 3/1972 | Kojima | E03F 5/0407 137/247.35 |
| 8,201,581 | B2 | 6/2012 | George | |
| 9,428,893 | B1 * | 8/2016 | Towers | E03C 1/29 |
| 10,364,558 | B2 * | 7/2019 | Swadesh | E03C 1/29 |
| 2002/0088051 | A1 * | 7/2002 | Nunez | E03C 1/29 4/679 |
| 2004/0177439 | A1 * | 9/2004 | Nunez | E03C 1/29 4/679 |

(Continued)

FOREIGN PATENT DOCUMENTS

| | | |
|---|---|---|
| FR | 3031121 A1 | 7/2016 |
| WO | 2021001833 A1 | 1/2021 |

OTHER PUBLICATIONS

International Search Report issued in Application No. PCT/IL2020/050740 dated Sep. 21, 2020, 3 pages.

(Continued)

*Primary Examiner* — Craig J Price

(57) ABSTRACT

The present invention relates to a siphon device with a bypass, comprising: a siphon upper section having a top coupling means for connecting to a drain outlet, a side drain opening having coupling means for connecting to a waste-water utility pipe, wherein the siphon upper section is adapted to enable a direct flow via the side drain opening and thereby to bypass a basin of the siphon, thus evacuating substantial volume of accumulated water directly into the wastewater utility pipe.

8 Claims, 11 Drawing Sheets

(56) References Cited

U.S. PATENT DOCUMENTS

| | | | | |
|---|---|---|---|---|
| 2005/0229305 | A1* | 10/2005 | Nocera | E03C 1/29 4/679 |
| 2009/0211963 | A1 | 8/2009 | Murray et al. | |
| 2011/0036417 | A1* | 2/2011 | McAlpine | E03C 1/29 137/247.13 |
| 2018/0355588 | A1 | 12/2018 | Sodo | |

OTHER PUBLICATIONS

Written Opinion issued in Application No. PCT/IL2020/050740 dated Sep. 21, 2020, 7 pages.

* cited by examiner

—Prior Art—

WATER TRAP HAVING A ROTARY VALVE

CROSS-REFERENCE TO RELATED APPLICATIONS

This application is a Continuation-in-part of International Application No. PCT/IL2020/050740 filed on Jul. 2, 2020, which claims the benefit of Israeli Application No. 270194 filed Oct. 27, 2019 and Israeli Application No. 267866 filed Jul. 4, 2019, all of which are incorporated by reference in their entireties herein.

FIELD OF THE INVENTION

The present invention is in the field of domestic sanitation. More particularly, the invention relates to a siphon with a bypass.

BACKGROUND OF THE INVENTION

In many cases, the relief of a clogged sink is a simple task, but it can be an uncomfortable and unpleasant task in some of these cases. For many years a plurality of siphon devices have been utilized for isolating the unpleasant odor of the drainage plumbing from rising up through the sink's drainage by forming a water trap. The water trap is connected in line between the sink's drainage and the downstream wastewater pipe.

FIG. 1A schematically shows a widely used water trap which is also known as a "Siphon", or a "Bottle trap". The siphon of the prior art is commonly installed with a tubular connection adapter 1 with a proximal threaded connection 1*a* which connects to drainage of a sanitary vessel such as a handwashing sink, an adapter pipe 1*b* through which drained water flows into an inner tube 2 of the siphon, and a distal threaded connection 1*c* which connects to the upper section 4 of the siphon. The siphon itself comprises inner tube 2, a siphon basin 3, and a siphon upper section 4, which comprises drain outlet 5, which is connected to the downstream wastewater pipe (not shown). The drain water flows through the sink drainage into inner tube 2, down to basin 3 in which the water accumulates, and drain through outlet 5. While the drain water flow and accumulate at basin 3, heavy particles and foreign objects (e.g., hair pins) sink and are trapped, thus achieving two goals of trapping the wastewater odor (i.e., the accumulated water prevents odors passage through basin 3) and preventing clogging elements from passing to the downstream wastewater pipe, thus allowing a simple relief of a clogged sink by threading out basin 3 (i.e., after preparing bellow a suitable vessel for the clogged water), relieving the clogged water, cleaning the clogging matter and trapped objects, and threading back basin 3.

The abovementioned clog relief process is very simple to perform, yet the need to drain the substantial volume of accumulated water above the clogged basin (i.e., which in many cases starts flowing out with clogging matter at the initial relief of basin 3), turn the process to be fairly uncomfortable and unpleasant.

It is an object of the present invention to provide a siphon with evacuation means for an effortless relief of a clogged sink, by evacuating accumulated water above the clogged siphon directly into the wastewater utility pipe.

Other objects and advantages of the invention will become apparent as the description proceeds.

SUMMARY OF THE INVENTION

The present invention relates to a siphon device with a bypass, comprising: a siphon upper section having a top coupling means for connecting to a drain outlet, a side drain opening having coupling means for connecting to a wastewater utility pipe, wherein said siphon upper section is adapted to enable a direct flow via said side drain opening and thereby to bypass a basin of said siphon, thus evacuating substantial volume of accumulated water directly into the wastewater utility pipe.

According to an embodiment of the invention, the siphon upper section adapted to receive an inner tube which is detachably connected to the siphon upper section by coupling means selected from the group consisting of: threading, snap-fit, and Bayonet arrangement, wherein the detachment of said detachably connected inner tube from said siphon upper section, enables a direct flow of accumulated water into the wastewater utility pipe.

According to an embodiment of the invention, the inner tube is provided with a peripheral wiping element.

According to an embodiment of the invention, the siphon upper section comprises a fixed tube having at least one first bypass opening facing the side drain opening, and a rotatable tube which is concentric with said fixed tube and which comprises at least one second bypass opening, wherein said siphon can be rotatably shifted from a closed bypass state at which said at least one second bypass opening is blocked by the wall of said rotatable tube, to an open bypass state, by turning said rotatable tube respectively to said fixed tube to the extent at which said at least one second bypass opening overlaps with said at least one first bypass opening, thereby enabling a direct flow of accumulated water into the wastewater utility pipe.

According to an embodiment of the invention, the fixed tube is located within the rotatable tube. According to another embodiment, the rotatable tube is located within the fixed tube.

According to an embodiment of the invention, the rotatable tube is rotated by a shifting knob, coupled with said rotatable tube through a guiding groove within the coupling area of the siphon basin and top section.

According to an embodiment of the invention, the siphon basin is provided with protruding means for reducing the required effort for threading of said siphon basin onto and out from the siphon upper section.

According to an embodiment of the invention, the drain outlet is of a sanitary vessel selected from the group of: handwashing sink, kitchen sink, and urinary vessel.

According to an embodiment of the invention, the coupling means are selected from the group of threading and bayonet arrangements.

According to an embodiment of the invention, the siphon upper section comprises a fixed tube having at least one first bypass opening facing the side drain opening, and a slideable tube that is concentric with said fixed tube, wherein said siphon can be axially shifted from a closed bypass state at which said slideable tube covers said at least one first bypass opening, to an open bypass state by linearly sliding said slideable tube respectively to said fixed tube to the extent at which said at least one first bypass opening is uncovered, thereby enabling a direct flow of accumulated water into the wastewater utility pipe.

According to an embodiment of the invention, the siphon further comprises one or more gaskets for providing odor isolation between the fixed tube and the rotatable tube.

According to an embodiment of the invention, the siphon further comprises one or more gaskets for providing odor isolation between the fixed tube and the slideable tube.

According to an embodiment of the invention, the slideable tube comprising at least one second bypass opening of which sliding operation of said slideable tube uncovers or covers the at least one first bypass opening of the fixed tube, wherein a closed bypass state is defined by non-alignment of said first and second bypass openings and an open bypass state is defined by alignment of said first and second bypass openings, thereby enabling or disabling a direct flow of accumulated water directly into the wastewater utility pipe.

DETAILED DESCRIPTION OF THE DRAWINGS

The present invention relates to a siphon with an inner tube, which is adapted to enable a direct flow above the clogged basin of the siphon, thus evacuating a substantial volume of accumulated water directly into the wastewater utility pipe.

Reference will now be made to several embodiments of the present invention, examples of which are illustrated in the accompanying figures for purposes of illustration only. One skilled in the art will readily recognize from the following description that alternative embodiments of the comprising elements herein may be employed without departing from the principles of the claimed invention.

Figure 1A:
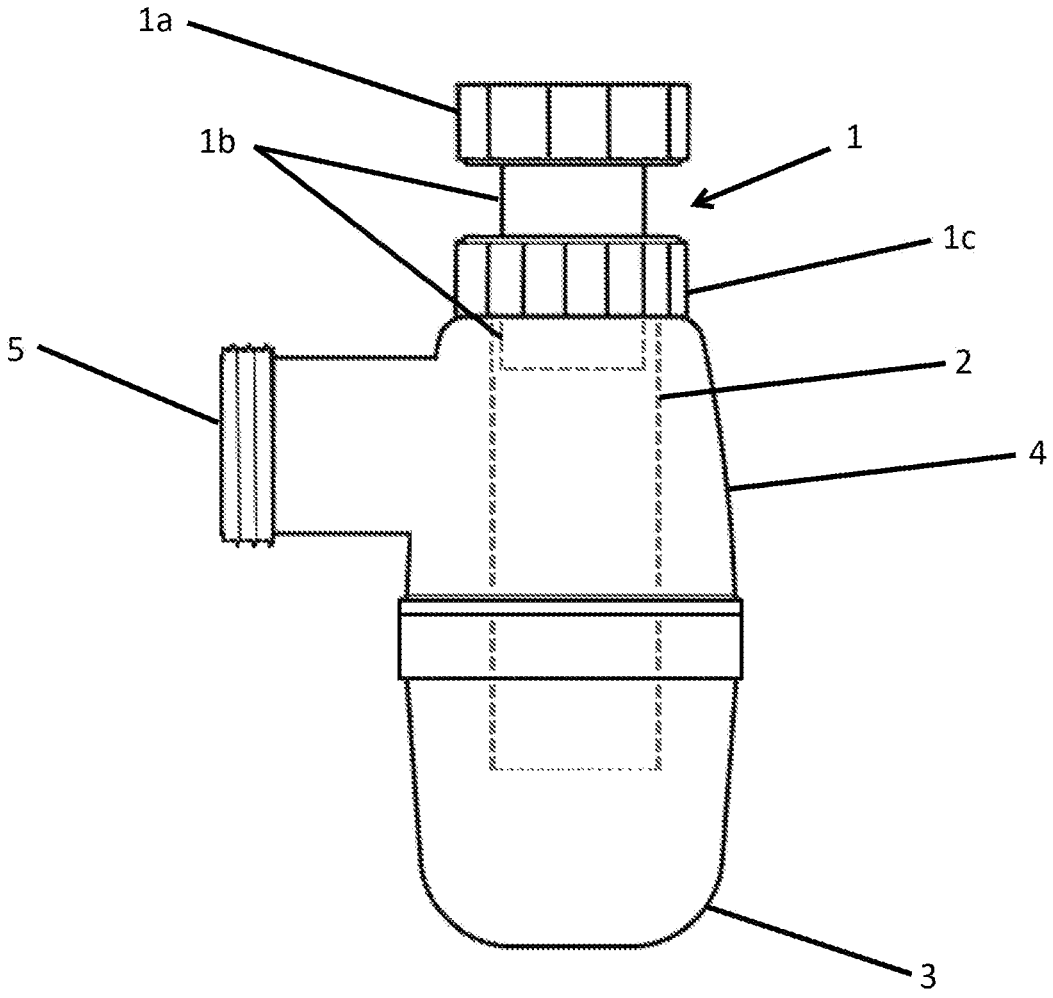
FIG. 1A schematically shows a widely used water trap, according to the prior art.
Figure 1B:
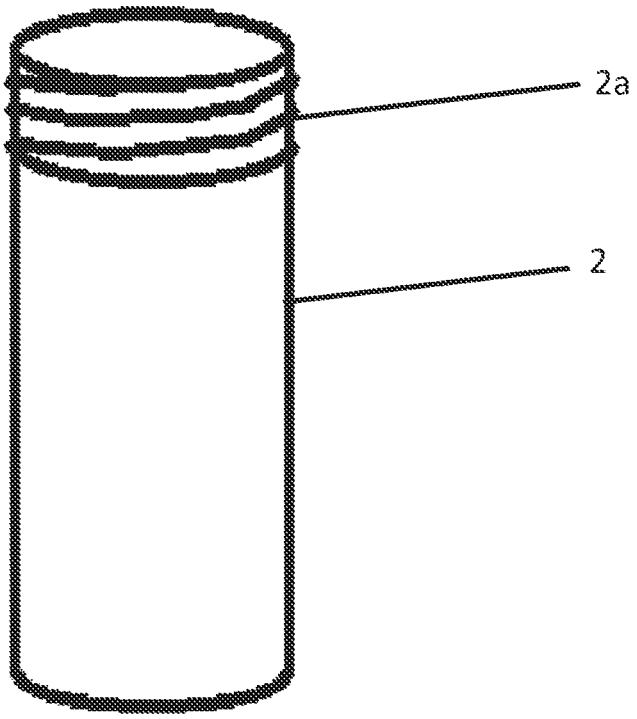
FIGS. 1B-1C schematically illustrate a siphon with a detachable inner tube, according to an embodiment of the present invention.
Figure 1C:
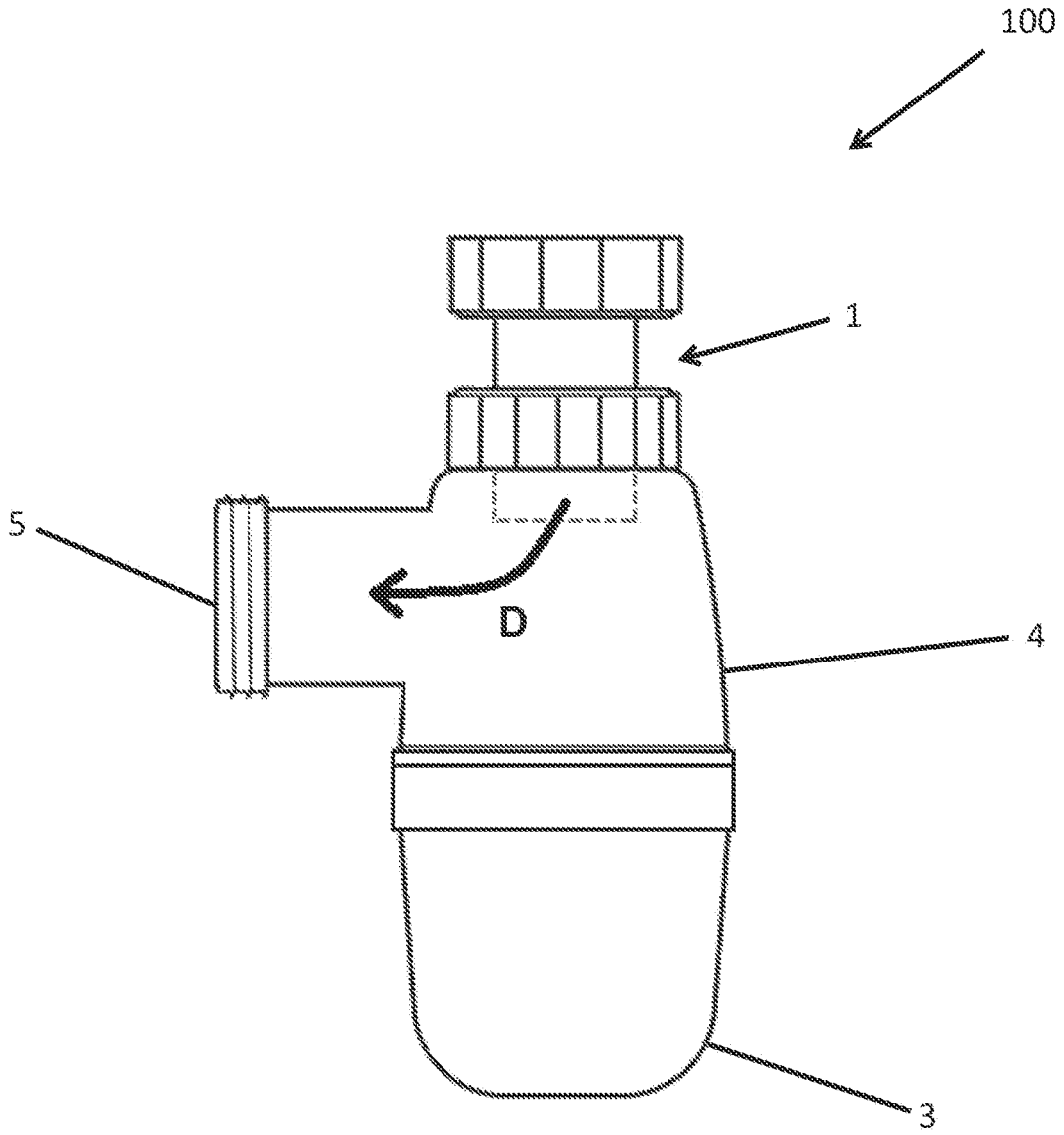

FIGS. 1B-1C schematically illustrate a siphon 100, according to an embodiment of the present invention, in which siphon 100 comprises a detachable inner tube 2, wherein detachable inner tube 2 is detachably connected to upper section 4 by suitable means such as an external threading 2*a* on the top portion of detachable inner tube 2 (FIG. 1B) and a corresponding inner threading in upper section 4. Of course, alternate mechanical joint arrangements such as Bayonet or snap-fit arrangements can be used in lieu or in conjunction with threading 2*a*.

Figure 7:
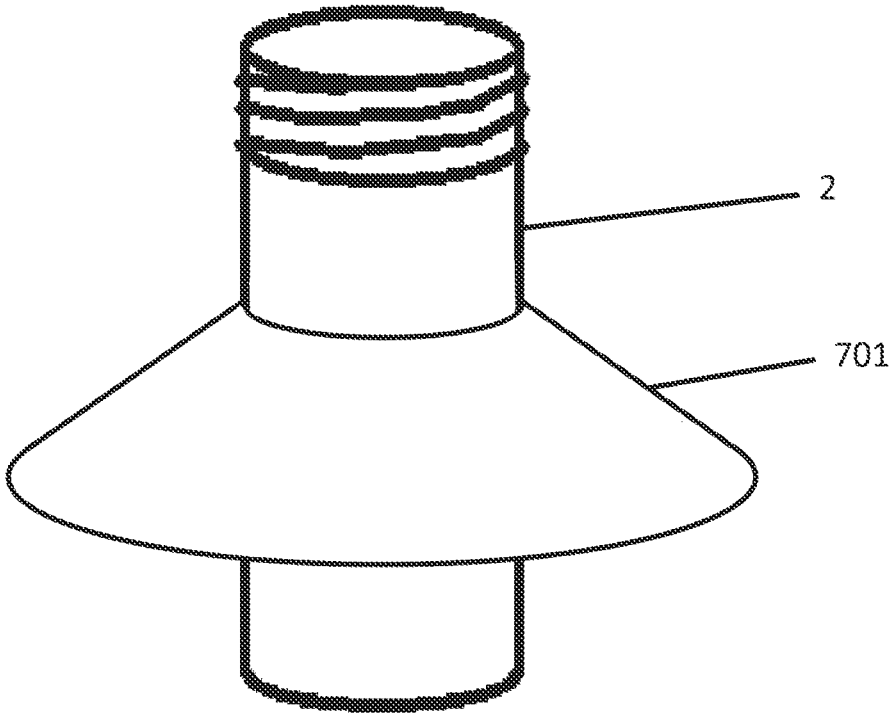
FIG. 7 schematically illustrates a front view of a detachable inner tube of the siphon of FIG. 1B having a peripheral wiping element, according to an embodiment of the present invention.

Whenever a significant quantity of sunken heavy matter, or foreign objects clog siphon 100, a drainage vessel can be placed below siphon 100, the drainage of the sanitary vessel (e.g., sink) to which siphon 100 is connected is blocked by a stopper (e.g., a rubber drain stopper or other drainage closing means), basin 3 is being removed and cleared from the clogging matter/objects, detachable inner tube 2 is being removed, basin 3 is re-assembled and the drainage of the sanitary vessel can be opened, thereby enabling a bypass flow of clogged water directly to drain outlet 5 (as indicated with the letter D). According to some embodiments of the present invention, detachable inner tube 2 is provided with a peripheral wiping element 701, as illustrated in FIG. 7, whereas detachable inner tube 2 is being removed, wiping element 701 wipes the inner wall of upper section 4 from undesirable adhered matter, thus improving the cleaning operation and providing elongated period before further clogging occurs. While wiping element 701 of FIG. 7 is illustrated near the mid-height of inner tube 2, it can be installed at alternate positions, e.g., near the top of inner tube 2.

According to an embodiment of the present invention, a Bayonet coupling arrangement is utilized in lieu of threading for connecting detachable parts of siphon 100, such as detachable inner tube 2, basin 3, or upper section 4.

Of course, any detachable connection (e.g., between basin 3 and upper section 4 or between detachable inner tube 2 and upper section 4) may leak, and in the absence of detachable inner tube 2, an unpleasant odor may pass through, and therefore, according to an embodiment of the present invention, siphon 100 is provided with suitable sealing means (e.g., rubber O-Rings, rubber gaskets). According to some embodiments of the present invention, a tight fitness design of connected elements is utilized for providing odor and fluid escape).

According to some embodiments of the present invention, the bypass flow of clogged water directly to drain outlet 5 is enabled by two flow openings, within two concentric tubes of which inner tube 2 is comprised, where one of the tubes can rotate with respect to the other, thus allowing a selection between two states of open/closed off bypass (i.e., where the two apertures can selectively be overlapping or be positioned away) as further illustrated in the following embodiments.

Figure 2A:
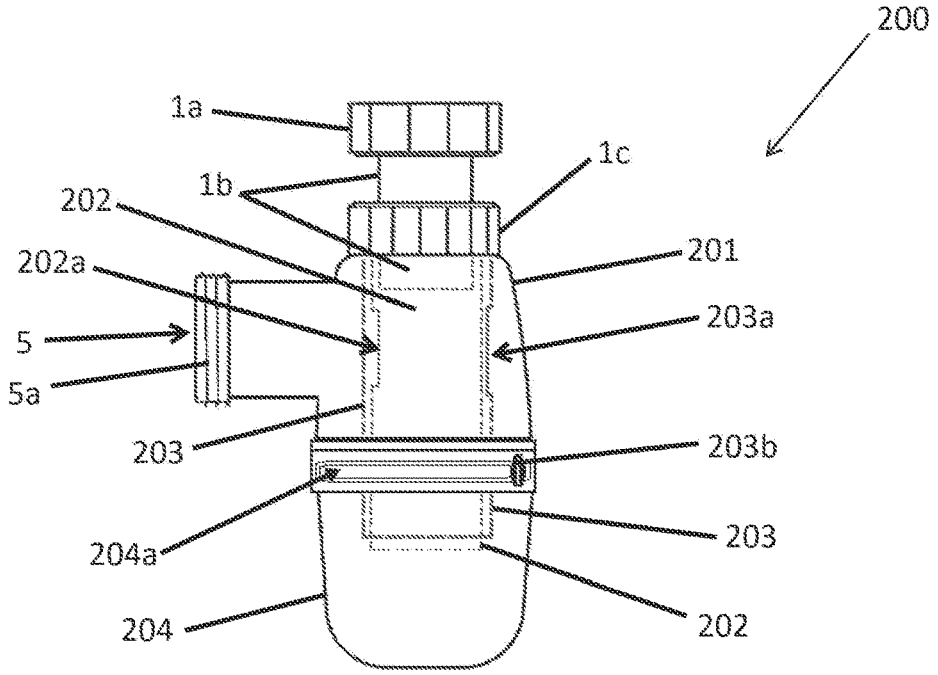
FIG. 2A schematically illustrates a side view of a siphon in its closed off bypass state, according to an embodiment of the present invention.

FIG. 2A schematically illustrates a side view of a siphon 200 in its closed off bypass state, according to an embodiment of the present invention, in which siphon 200 is installed with a connection adapter 1 having a proximal threaded connection 1*a* which connects to a sanitary vessel (e.g., handwashing sink, kitchen sink, urinary vessel etc.), an adapter pipe 1*b* through which drained water flows into a fixed tube 202 of siphon 200 and a distal threaded connection 1*c* which connects to corresponding threading of top section 201 of siphon 200. Of course, different coupling means can be selected by a person skilled as an alternative to the common threading means in accordance to different applications of siphon 200. Furthermore, siphon 200 is not limited to use in conjunction with adapter 1 and multiple different installation variants are possible, such as a direct connection to the drainage of a sanitary vessel having suitable coupling means.

Figure 8:
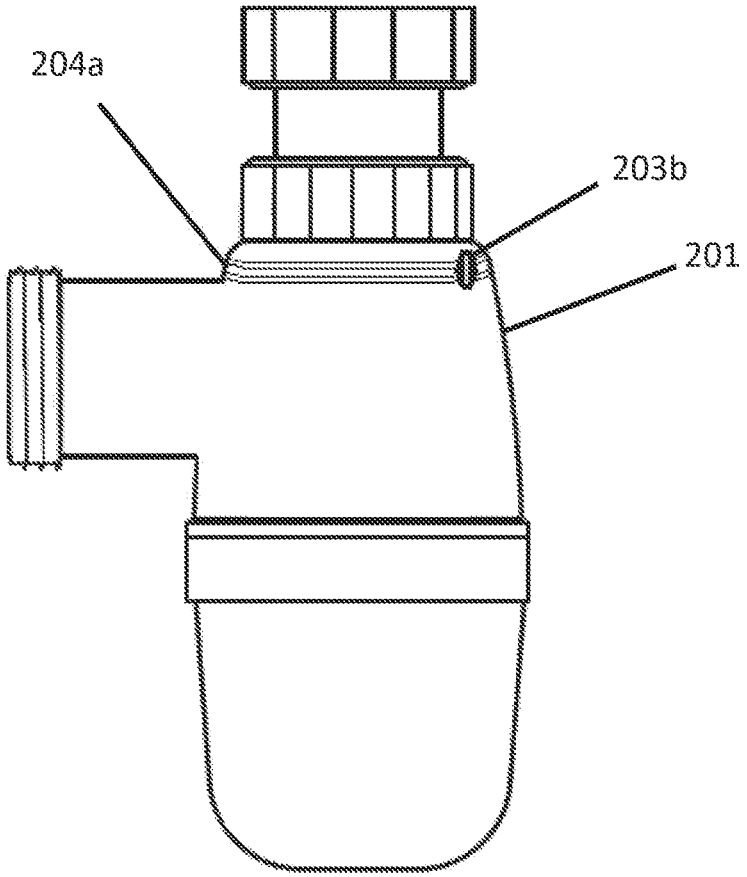
FIG. 8 schematically illustrates a side view of a siphon, according to another embodiment of the present invention.

Siphon 200 comprises a top section 201, with a side drain opening 5 having coupling means, such as a threading 5*a* (i.e., for connecting to the wastewater utility pipe), a fixed tube 202, comprising at least one first bypass opening 202*a* facing opening 5, and a rotatable tube 203 having at least one second bypass opening 203*a* and defining fixed tube 202. Siphon 200 further comprises a siphon basin 204 with a guiding groove 204*a* for guiding the travel of a rotation knob 203*b* of rotatable tube 203, wherein by shifting rotation knob 203*b*, rotatable tube 203 is rotated (i.e., with respect to fixed tube 202), thus shifting siphon 200 from a default closed off bypass state, where second bypass opening 203*a* does not overlap with first bypass opening 202*a* (i.e., first bypass opening 202*a* is blocked by the wall of said rotatable tube 203), to an open bypass state (shown in FIG. 2B), where second bypass opening 203*a* overlaps with first bypass opening 202*a*, thereby relieving a substantial portion of the accumulated water to the wastewater utility pipe as will be further illustrated in FIGS. 3A-3C. One skilled in the art will appreciate alternate installation positions for the shifting mechanism, for example, near to the top of top section 201 (as illustrated in FIG. 8), in accordance with specific embodiments of the proposed siphon device. As can be easily seen in FIGS. 2A, 2B and FIG. 8, rotation knob 203*b* protruding outwardly from the outer surface of the siphon device, thereby enabling a user to handle a clogged sink without requiring to disassemble the siphon. In other words, such configuration eliminates the need to disassemble any part of the siphon, e.g., such as the siphon basin 204, which is usually required to be assembled in order to handle a clogged situation.

Figure 2B:
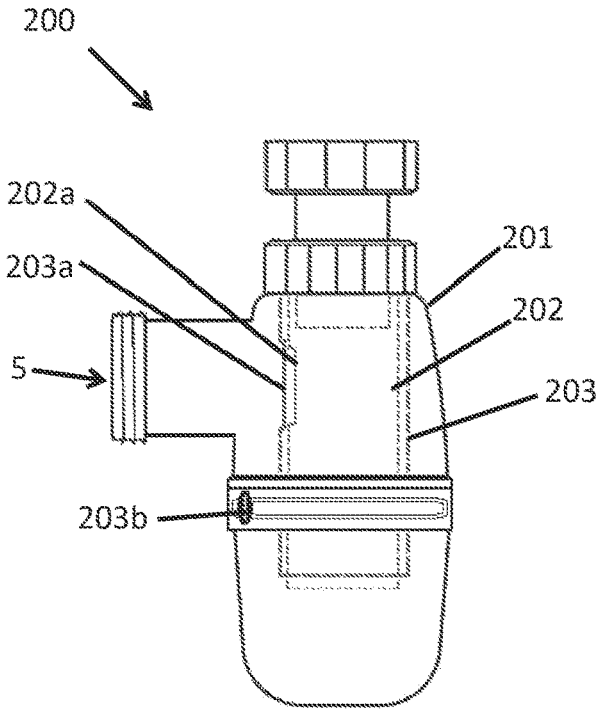
FIG. 2B schematically illustrates a side view of the siphon of FIG. 2A in its opened bypass state, according to an embodiment of the present invention.
Figure 2C:
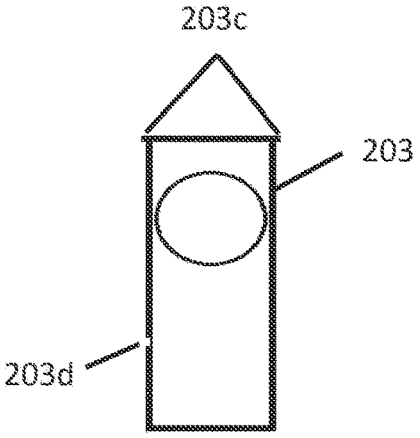
FIG. 2C schematically illustrates a front view of a rotatable tube of the siphon of FIG. 2A, according to an embodiment of the present invention.

FIG. 2C schematically illustrates a front view of rotatable tube 203, according to an embodiment of the present invention, in which rotatable tube 203 comprises a top annular flange 203*c* for stabilizing rotatable tube 203 against a corresponding internal groove (not shown) inside top section 201, and a threaded socket 203*d* which is suitably located to allow easy threading of rotation knob 203*b* through guiding groove 204*a*, thus together with flange 203*c* provides the required support and rotation capability of rotatable tube 203.

Figure 3A:
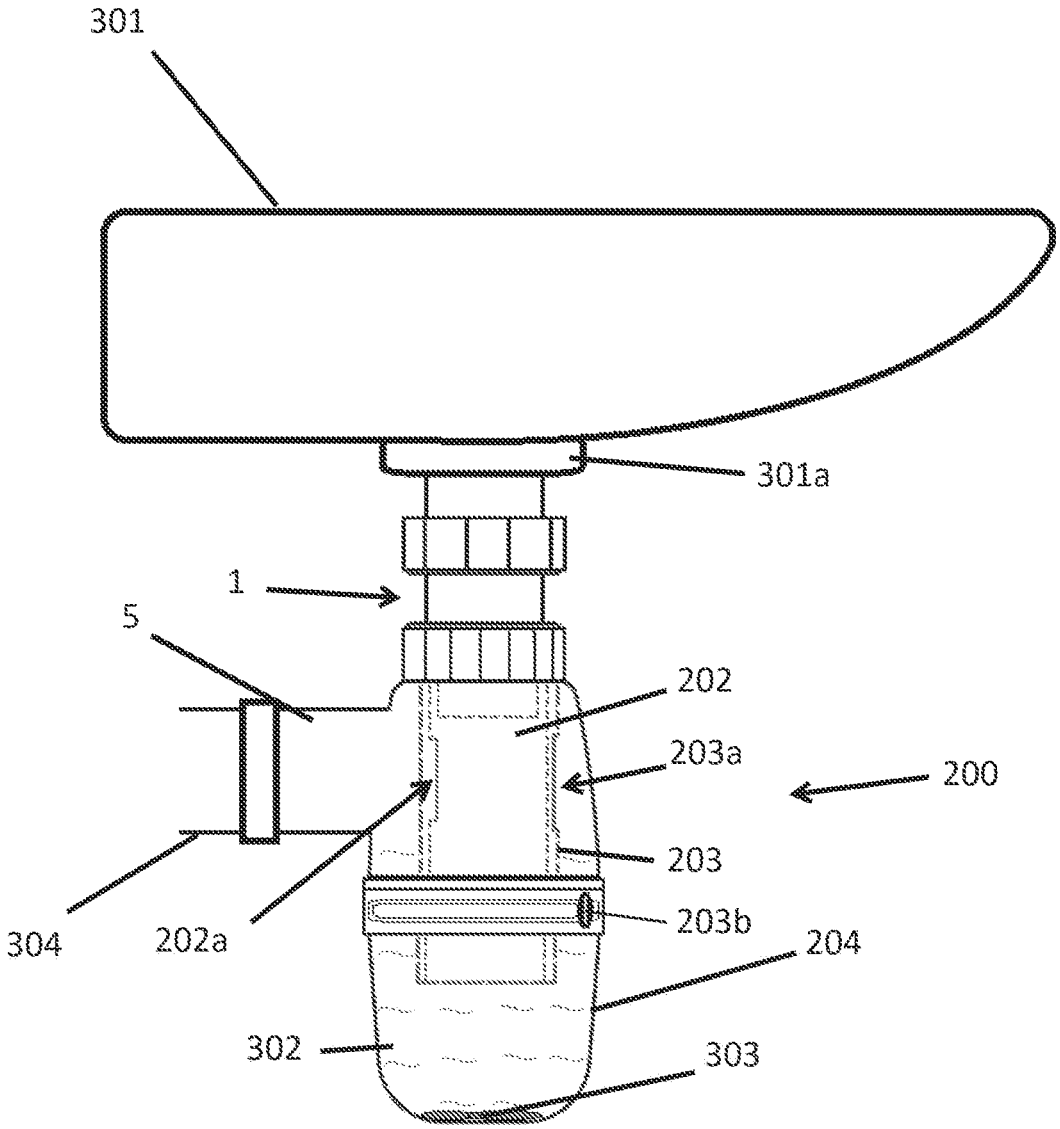
FIG. 3A schematically illustrates a side view of the siphon of FIG. 2A installed under a sink, according to an embodiment of the present invention.

FIG. 3A schematically illustrates a routine side view of siphon 200 assembled with sink 301, according to an embodiment of the present invention, in which adapter 1 is connected to the sink drainage element 301*a* of sink 301 and siphon 200 is in its closed off bypass state (i.e., bypass opening 203*a* of rotatable tube 203 is turned to the opposite direction, relative to bypass opening 202*a* of rotatable tube 202), wherein outlet 5 is connected to the wastewater pipe inlet 304. Further shown in FIG. 3A is a normal accumulation of waters 302 with a small quantity of clogging matter 303 at the bottom of siphon basin 203.

Figure 3B:
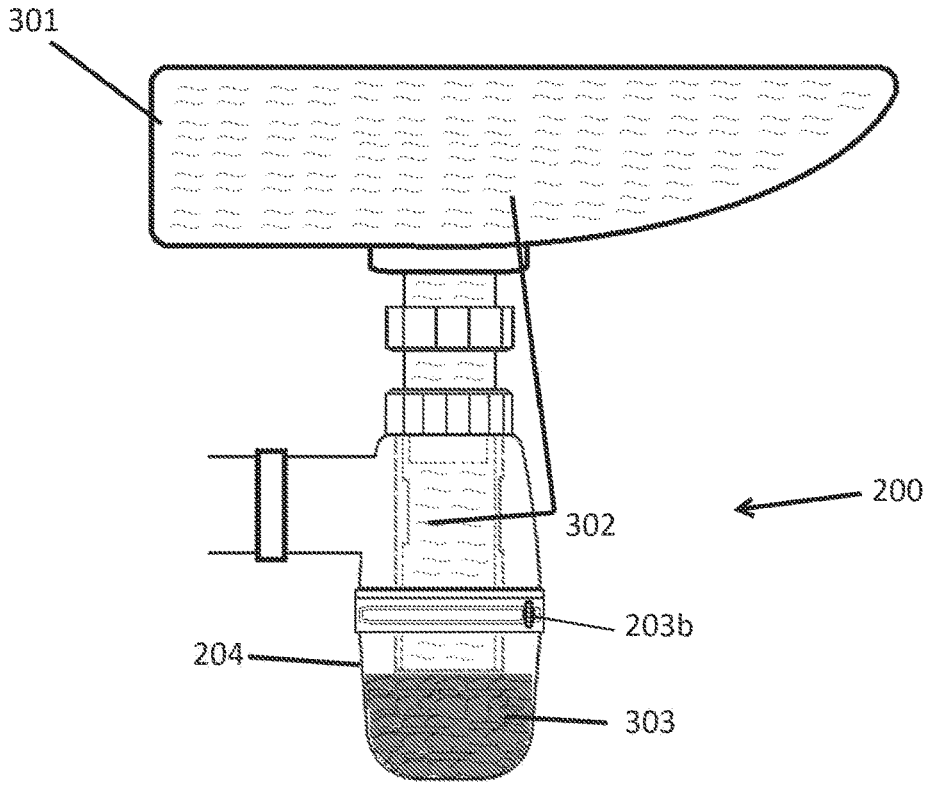
FIG. 3B schematically illustrates a side view of the installation of FIG. 3A in a clogged sink situation with the siphon in its closed off bypass state, according to an embodiment of the present invention.

FIG. 3B schematically illustrates a side view of sink 301 in a clogged sink situation with siphon 200 in its closed off bypass state, according to an embodiment of the present invention, in which clogging matter 303 has accumulated at the bottom of siphon basin 204 to an extent that prevents water flow through basin 204, resulting with a substantial quantity of water 302 accumulated within siphon 200 and sink 301.

Figure 3C:
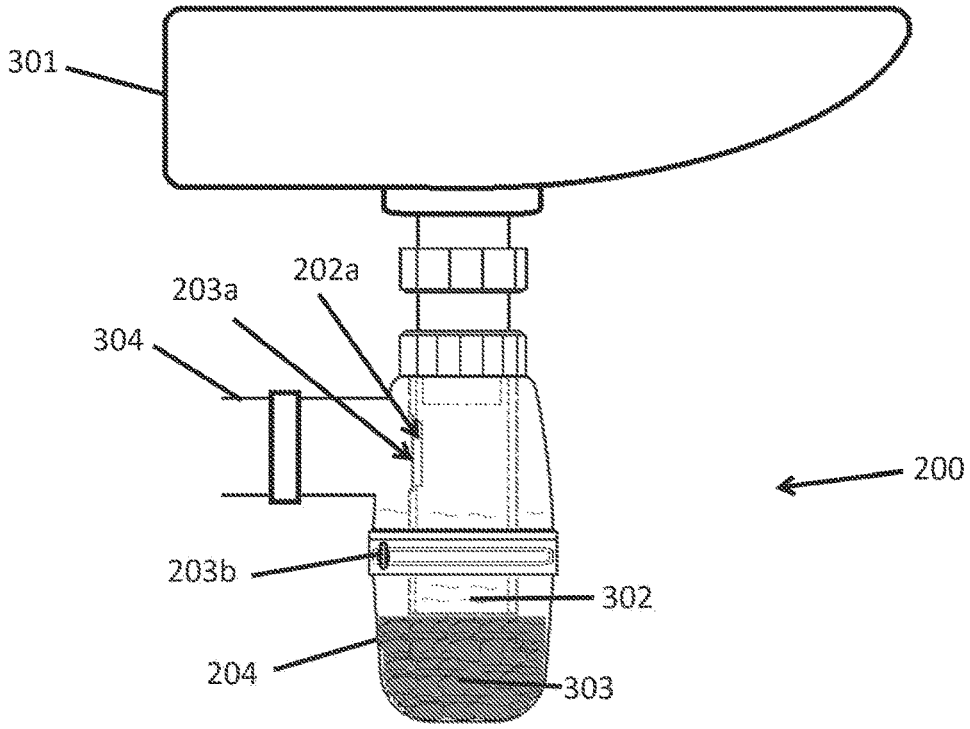
FIG. 3C schematically illustrates a side view of the installation of FIG. 3A in the clogged sink situation with the siphon in its opened bypass state, according to an embodiment of the present invention.

FIG. 3C schematically illustrates a side view of sink 301 in a clogged sink situation with siphon 200 in its opened bypass state, according to an embodiment of the present invention, in which knob 203*b* is shifted, thus shifting siphon 200 to an open bypass state, wherein bypass opening 203*a* overlap with bypass opening 202*a*, thereby relieving a substantial portion of the accumulated water from sink 301 and siphon 200 to the wastewater pipe 304, and allowing an effortless detachment of basin 204, disposal of clogging matter 303 and reassembly of basin 204 (i.e., with a corresponding unthreading and re-threading of knob 203*b* into rotatable tube 203).

One skilled in the art could readily realize multiple different mechanical arrangements, which can provide the support and rotation of rotatable tube 203 with respect to fixed tube 202 without departing the principals of the proposed siphon 200, such as fastening of rotatable tube 203 to siphon basin 204 while having basin 204 and top section 201 provided with suitable coupling and means such as a bayonet arrangement. Furthermore, while FIGS. 1-3 illustrate siphon 200 with a fixed inner tube (i.e., fixed tube 202) and an outer rotatable tube (i.e., rotatable tube 203), according to some embodiments of the invention, other embodiments of the invention comprise an inner rotatable tube that is inserted within a fixed outer tube. For example, siphon 400 of FIG. 4 which comprises a top section 4 (shown with a sectioned bottom) with a fixed tube 401, and an inner rotatable tube 402 positioned within the fixed tube 401, wherein the upper portion of rotatable tube 402 is inserted into tube 1*b* of adapter 1 and the lower portion of rotatable tube 402 is connected to the lower portion of fixed tube 401 by bayonet plug 402*a* threaded into a corresponding bayonet socket 401*a* of fixed tube 401, allowing the shifting of siphon 400 from a closed bypass state (i.e., where the wall of rotatable tube 402 blocks a bypass opening 401*b*) to an open bypass state, in which bypass opening 402*b* overlap with bypass opening 401*b*.

Figure 4:
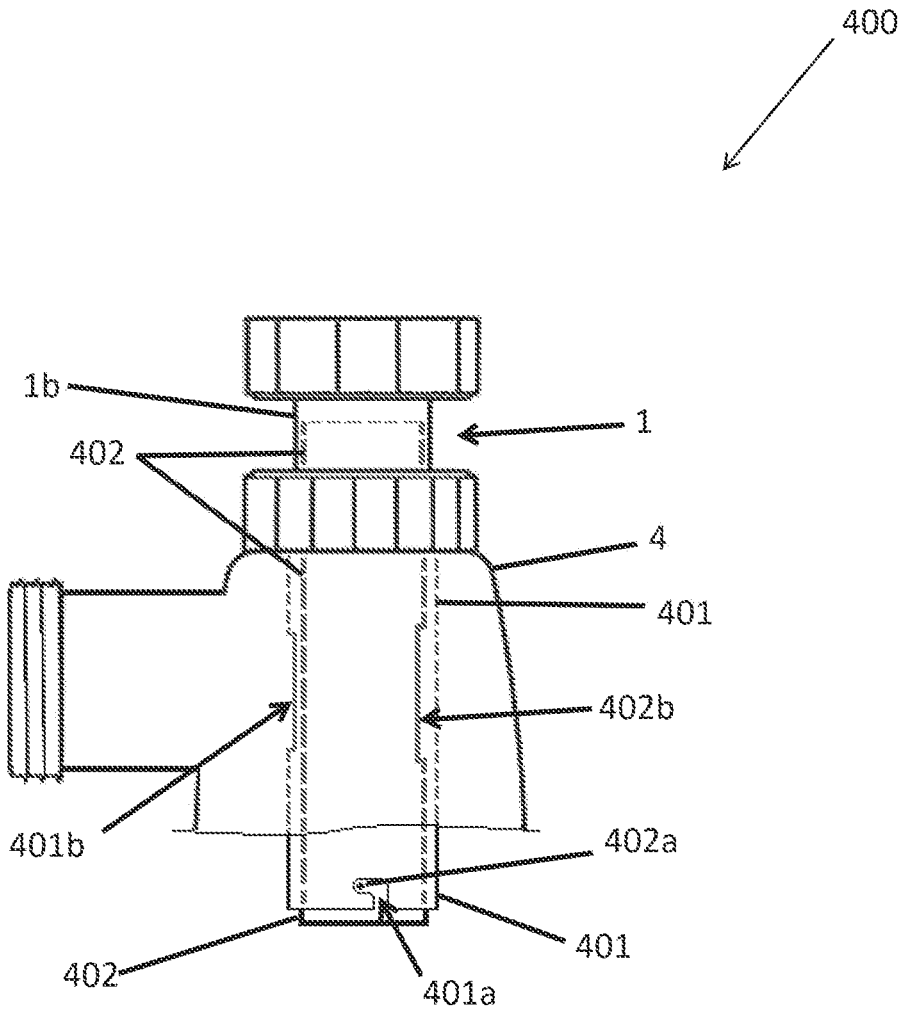
FIG. 4 schematically illustrates a side view of a siphon with a sectioned bottom, according to an embodiment of the present invention.

Furthermore, the proposed siphon device can be provided with an axial alignment of the bypass openings in lieu of the aforementioned rotational alignment (i.e., having a fixed tube with a first bypass opening and a slideable tube with a second bypass opening, where the alignment of the first and second openings is achieved by linearly sliding the slideable tube respectively to the fixed tube, thus enabling the direct drainage of clogged water towards drain opening 5), with the corresponding adaptations of the alignment arrangements (i.e., in lieu of rotation knob 203*b* of FIG. 2B and the Bayonet arrangement of FIG. 4). Moreover, the proposed siphon device can be provided with a slideable tube not comprising a second opening of which sliding operation uncovers or covers the first bypass opening of the fixed tube, thereby enabling or disabling a direct flow of accumulated water directly into the wastewater utility pipe (i.e., bypassing a clogged basin of the siphon.

Figure 5:
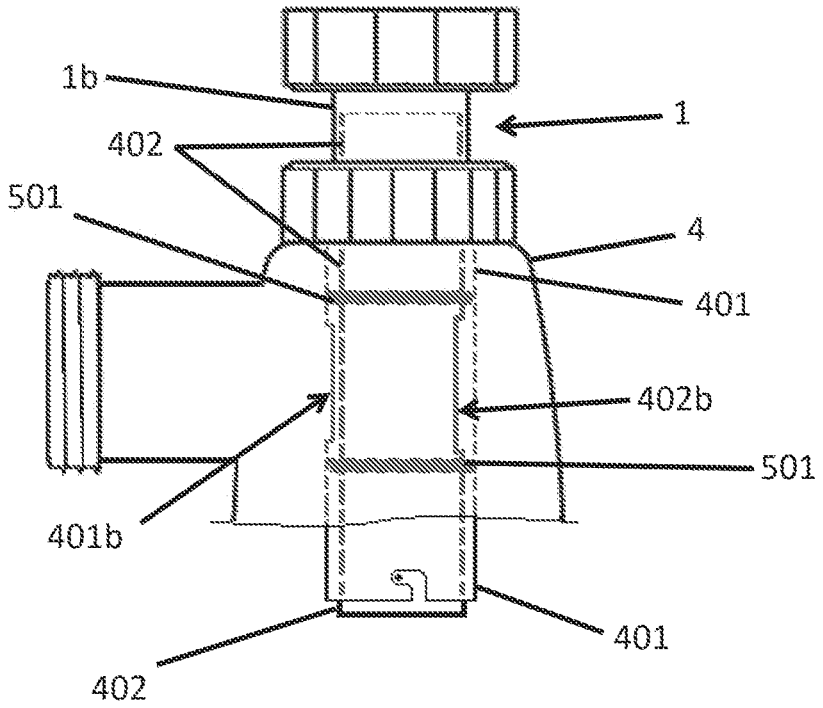
FIG. 5 schematically illustrates a side view of the siphon of FIG. 4 with O-ring gaskets, according to an embodiment of the present invention.

According to a preferred embodiment of the present invention, one or more gaskets for providing improved odors' isolation between tubes 401 and 402, such as O-ring gaskets 501 of FIG. 5 located above/below bypass openings 401*b* and 402*b*.

Figure 6:
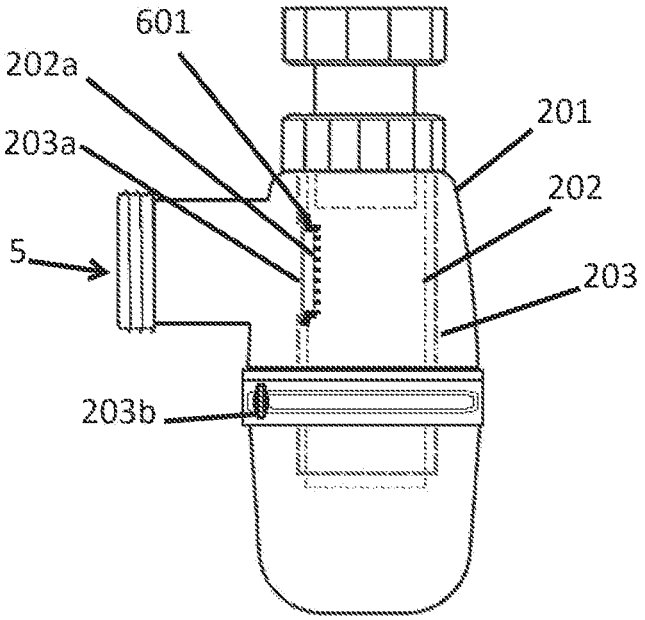
FIG. 6 schematically illustrates a side view of the siphon of FIG. 2A with a circumferential gasket on a bypass opening, according to an embodiment of the present invention.

According to another embodiment of the present invention shown in FIG. 6, a circumferential gasket 601 is installed onto the lip of 202*a* (of FIGS. 2A-2B), providing odors' isolation between the aligned bypass openings 202*a* and 203*a* of tubes 202 and 203. Of course, multiple alternative sealing elements can be selected by one skilled in the art in accordance with various embodiments of the present invention.

Although embodiments of the invention have been described by way of illustration, it will be understood that the invention may be carried out with many variations, modifications, and adaptations, without exceeding the scope of the claims.

What is claimed is:

1. A siphon device with a bypass, comprising: a siphon upper section with a top coupling means for connecting to a drain outlet, a side drain opening with coupling means for connecting to a wastewater utility pipe, wherein said siphon upper section allows direct flow through said side drain opening, bypassing a basin of said siphon, and evacuating a substantial volume of accumulated water directly into the wastewater utility pipe, wherein the siphon upper section includes a fixed tube with at least one first bypass opening facing the side drain opening and a rotatable tube that is concentric with said fixed tube and comprises at least one second bypass opening, wherein said siphon can be shifted from a closed bypass state, in which the rotatable tube blocks the second bypass opening, to an open bypass state by rotating the rotatable tube towards the fixed tube until the second bypass opening overlaps with the first bypass opening, wherein the fixed tube is located within the rotatable tube.

2. The siphon according to claim 1, in which the siphon upper section is adapted to receive an inner tube that is detachably connected to the siphon upper section by coupling means selected from the group consisting of: threading, snap-fit, and Bayonet arrangement, wherein the detachment of said detachably connected inner tube from said siphon upper section, enables a direct flow of accumulated water into the wastewater utility pipe.

3. The siphon according to claim 2, in which the inner tube is provided with a peripheral wiping element.

4. The siphon according to claim 1, in which the rotatable tube is rotated by a shifting knob, coupled with said rotatable tube through a guiding groove within a coupling area of the siphon basin and a top section.

5. The siphon according to claim 1, in which the siphon basin is provided with protruding means for reducing the required effort for threading of said siphon basin onto and out from the siphon upper section.

6. The siphon according to claim 1, in which the drain outlet is of a sanitary vessel selected from the group of: handwashing sink, kitchen sink, and urinary vessel.

7. The siphon according to claim 1, in which the coupling means are selected from the group of threading and bayonet arrangements.

8. The siphon according to claim 1, further comprising one or more gaskets for providing odor isolation between the fixed tube and the rotatable tube.

* * * * *